United States Patent [19]

Karns

[11] Patent Number: 4,485,642

[45] Date of Patent: Dec. 4, 1984

[54] ADJUSTABLE HEAT EXCHANGER AIR BYPASS FOR HUMIDITY CONTROL

[75] Inventor: Phil J. Karns, Baldwinsville, N.Y.

[73] Assignee: Carrier Corporation, Syracuse, N.Y.

[21] Appl. No.: 538,404

[22] Filed: Oct. 3, 1983

[51] Int. Cl.[3] ..... F25B 39/02

[52] U.S. Cl. ..... 62/515; 62/324.1; 62/408; 62/525; 165/101

[58] Field of Search ..... 62/186, 515, 525, 407, 62/408, 324.1; 238/2 B; 165/124, 101, 103

[56] References Cited

U.S. PATENT DOCUMENTS

| | | | |
|---|---|---|---|
| 3,500,657 | 3/1970 | Johnson | 62/408 X |
| 3,517,527 | 6/1970 | Bouchat | 62/408 X |
| 3,716,097 | 2/1973 | Kelp et al. | 165/101 X |
| 3,826,105 | 7/1974 | Marsteller | 62/186 |
| 3,831,670 | 8/1974 | Mullings | 62/515 X |
| 4,003,729 | 1/1977 | McGrath . | |
| 4,182,133 | 1/1980 | Haas et al. . | |
| 4,293,032 | 10/1981 | Asp | 165/101 |
| 4,429,734 | 2/1984 | Vandervaart | 165/124 X |

*Primary Examiner*—Lloyd L. King
*Attorney, Agent, or Firm*—Robert H. Kelly

[57] ABSTRACT

Apparatus for controlling the temperature and humidity of air to be conditioned are disclosed. A fan coil unit incorporates a heat exchanger and a bypass area. The bypass area includes a damper assembly for apportioning the air flow between the bypass area and the heat exchanger such that humidity control of the air flowing therethrough may be obtained.

11 Claims, 3 Drawing Figures

ADJUSTABLE HEAT EXCHANGER AIR BYPASS FOR HUMIDITY CONTROL

BACKGROUND OF THE INVENTION

1. Field of the Invention

This invention relates to a heat exchange unit for both controlling the temperature of air flowing therethrough and the humidity of the air being discharged therefrom. The system is particularly adaptable to residential air conditioning systems wherein bypass apparatus may be utilized to cause a portion of the air to flow through the heat exchanger serving as an evaporator and a portion of the air to bypass the heat exchanger.

2. Prior Art

It has been recognized in many geographical areas that proper air conditioning systems should not only lower the temperature of the space being served when the temperature therein has exceeded a predetermined level but should also decrease the relative humidity of the space as a function of the air conditioning. During a typical air conditioning operation, air from the enclosure to be conditioned is circulated over a heat exchanger. The heat exchanger absorbs heat energy from the air lowering its dry bulb temperature. If the temperature of the air is lowered beneath its dew point, then moisture from the air is condensed onto the heat exchanger surfaces and the actual amount of moisture contained in the air is reduced. Should the air to be cooled not be lowered in temperature beneath the dew point, then no water will be removed from the air and there will be no dehumidification effect. In fact, it is possible to increase the relative humidity of air being conditioned since if moisture is not removed from the air then when the dry bulb temperature is decreased the capability of the air to absorb moisture is also decreased and the ratio between actual moisture contained in the air and the amount of moisture that may be contained within the air is increased. Consequently, relative humidity can increase during the air conditioning process.

To provide for additional latent cooling it is necessary to lower the temperature of the heat exchanger such that air passing through the heat exchanger will be lowered in temperature below the dew point and moisture will be removed therefrom. One manner of reducing the temperature of the heat exchanger has been by varying the fan speed to adjust the rate of flow of air over the heat exchange surface. Reduction in flow rate allows the temperature of the coil to decrease and consequently additional moisture may be removed from the air.

Another method of lowering the temperature of the coil over which the air passes is to limit the number of circuits in the coil through which the refrigerant flows. By limiting the number of circuits each circuit has a larger refrigerant flow volume and hence is maintained at a cooler temperature. Hence, by limiting the number of refrigerant flow circuits the temperature of the coil may also be reduced such that additional moisture is removed from the air to be conditioned. Through experimentation it has been discovered that most humans are comfortable when the temperature humidity index is less than 70. Once the temperature humidity index level reaches 75, approximately half the population is uncomfortable and at the level of 80, most of the population is uncomfortable. The temperature humidity index level is determined by multiplying the sum of the wet bulb and dry bulb temperatures by a factor of 0.4 and adding 15. It is the purpose of the present invention to decrease the dry bulb temperature through the normal air conditioning process of the air being circulated to cool an enclosure and to additionally decrease the wet bulb temperature such that a combination of these two factors maintains the temperature humidity index level within the comfort range. The utilization of a bypass area and a damper to adjust the flow of air between flowing through the heat exchangers and flowing through the bypass area is utilized to attempt to achieve the combination of wet bulb and dry bulb temperatures desired to maintain the space being conditioned within the target temperature humidity index level.

As shown herein, a manual device is used for positioning a damper to apportion air flow between air flowing through the heat exchanger and being cooled and air bypassing the heat exchanger. By bypassing a portion of the air, the air flow through the heat exchangers is reduced and consequently the temperature of the heat exchanger is lowered such that additional moisture may be removed from the air passing in heat exchange relation with the heat exchanger since it may be cooled to a lower temperature. The apportionment of air between flowing through the heat exchanger and bypassing the heat exchanger allows the individual to control in each instance the operation of the indoor heat exchanger to achieve the desired coil surface temperatures and thereby to hopefully achieve the desired temperature humidity index level.

Although not a part of the instant patent application, it is further envisioned that a stepper motor or similar motion device could be utilized to regulate the position of the damper in response to a humidistat sensing the humidity level in the enclosure to be conditioned.

SUMMARY OF THE INVENTION

It is an object of this invention to provide an indoor heat exchange unit for use with an air conditioning system having improved dehumidification capabilities.

It is a further object of this invention to apportion the air flowing through the heat exchange unit between air flowing through the heat exchanger and air bypassing the heat exchanger.

It is a still further object of this invention to provide both dry bulb and wet bulb temperature control over an area to be conditioned.

It is another object of the present invention to provide apparatus for use in reversible refrigeration systems as well as air conditioning cooling only systems which may be utilized to control the humidity levels in the cooling mode of operation.

It is a still further object of the present invention to provide a safe, economical and reliable system for better maintaining a given humidity and temperature level within an enclosure.

It is a still further object of the present invention to provide apparatus which both serves to allow the amount of air being bypassed around the heat exchanger to be regulated and to structurally secure the heat exchangers in an A-type configuration.

These and other objects of the present invention are achieved utilizing a heat exchange unit for controlling the temperature and humidity of air to be conditioned. The heat exchange unit has a casing defining an air flow path, a heat exchanger located in the air flow path within the casing for transferring heat energy between the fluid flowing through the heat exchanger and at least a portion of the air flowing through the casing, said heat exchanger extending across a portion of the air flow path defining a bypass area through which air may flow through the unit without being in heat exchange relation with the heat exchanger. Damper means are mounted to regulate the flow of air through the bypass area to apportion the air flow whereby a portion of the air flows through the heat exchanger and a portion of the air flows through the bypass area. In addition, a damper may be mounted by end plates for rotatable motion, said end plates further serving to secure the heat exchangers in position.

A heat exchange unit including an A-type indoor heat exchanger for use with an air conditioning system for supplying conditioned air is also disclosed. A pair of heat exchange coils are angled in opposite directions with the top portion of the two coils being closer together than the bottom portion of the heat exchange coils. A casing in which the heat exchange coils are located is additionally provided, said casing defining an air flow path therethrough. A bypass area is defined within the casing through which air may flow through the casing without flowing through the heat exchanger. Damper means are mounted to regulate air flow through the bypass area to apportion the air flow through the casing between air flowing through the bypass area and air flowing through the heat exchange coils.

DESCRIPTION OF THE PREFERRED EMBODIMENT

The embodiments described hereinafter will refer to A-type heat exchangers mounted within a casing through which air is circulated. By an A-type heat exchanger reference is made to an indoor heat exchanger having two heat exchange coils mounted such that the coils are generally forming the legs of the letter "A". Inverted V-shaped is also used to refer to coils of this structure. Such heat exchangers have two heat exchange coils which are angled towards each other with one end of the coils being adjacent to each other and the other end of the coils being distant from each other.

Additionally, as shown herein, a manual means or handle is provided for operating the bypass damper to apportion air flow between the bypass area and the heat exchanger. It is additionally contemplated that other means such as a stepper motor or other motion device may be utilized in combination with a humidistat or other control to effectively regulate the position of the damper to apportion the air flow.

It is further to be understood that although the present device is referred to as only being a heat exchange unit that the phrase "heat exchanger unit" may include other components such as a fan motor, a fan, heat exchangers for heating such as in a fuel fired furnace, electric resistance heaters or other similar heating, ventilating and air conditioning apparatus.

Figure 1:
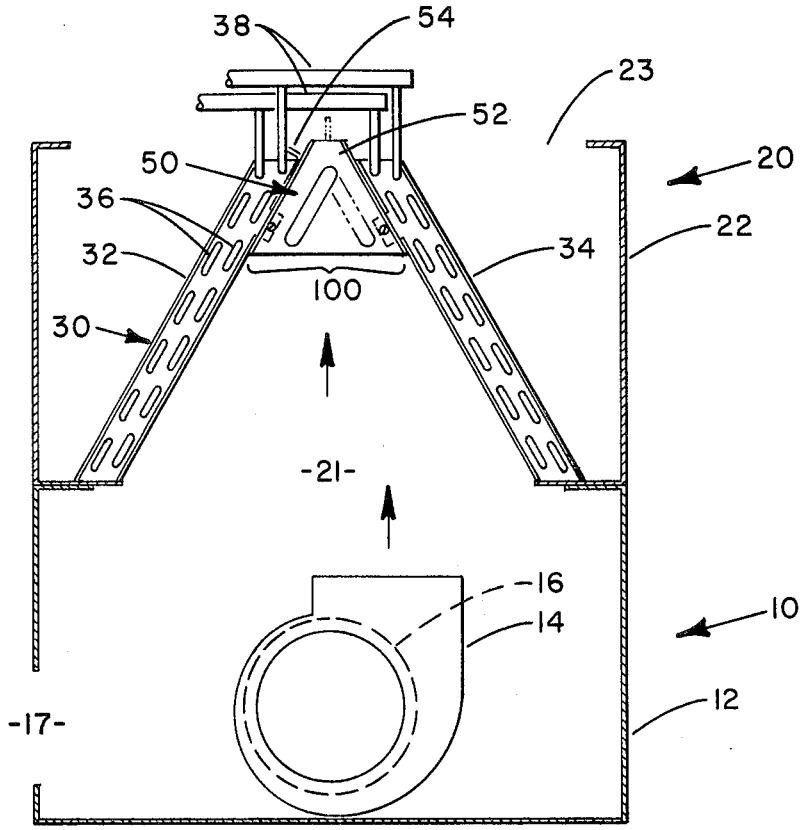
FIG. 1 is a plan type view of a combination blower unit and coil unit.

Referring now to the drawings, it can be seen in FIG. 1 that a blower unit 10 is shown having coil unit 20 mounted on top thereof. Blower unit 10 includes a casing 12 which defines return air opening 17 through which air may enter the casing and is shown discharging the air upwardly from the blower unit. Fan scroll 14 is shown mounted within the unit and has fan 16 which acts to draw air into the return air opening 17 and discharge the air upwardly.

Coil unit 20 is shown mounted on top of blower unit 10. Located within coil unit 20 is A-type heat exchanger 30 which includes left coil 32 and right coil 34. Casing 22 defines an air flow path including coil unit inlet 21 through which air from the blower unit 10 is received and coil unit outlet 22 through which air is discharged to be circulated back to the space to be conditioned. Each coil includes return bends 36 for connecting the various tubes extending through the heat exchanger to form a serpentine flow path for directing refrigerant therethrough. Bypass assembly 50 is shown at the top end of heat exchanger coil 30 wherein it physically connects the left coil to the right coil to support same. An end plate 52 is shown mounted to connect the two coils together. Damper 54 is shown in a vertically mounted position rotatably mounted to end plate 52. Additionally, headers 38 are shown connected to the two refrigerant coils for appropriately routing the refrigerant being circulated therethrough.

Figure 2:
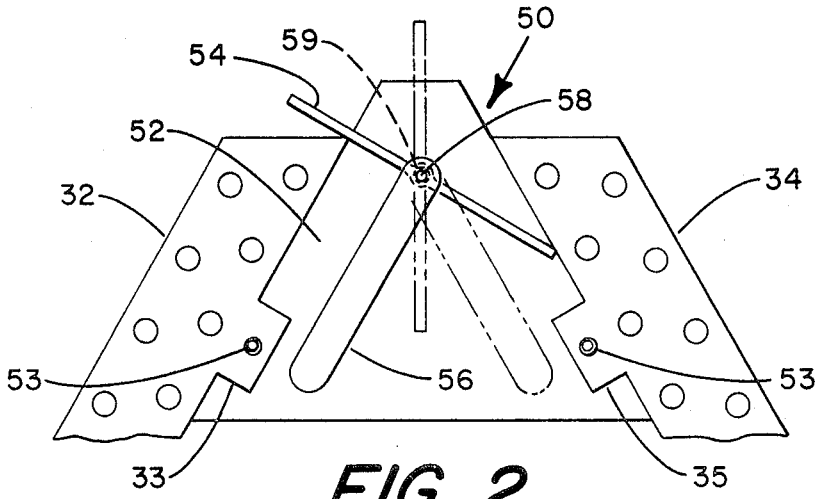
FIG. 2 is an enlarged view of the bypass assembly portion of FIG. 1.

Referring now to FIG. 2, which is an enlarged view of the bypass assembly 50 of FIG. 1, the specific structural arrangement between the components may be seen. Left coil 32 is shown having a support flange 33 extending inwardly therefrom. Right coil 34 has support flange 35 extending inwardly therefrom. Fasteners 53 are shown in each instance for securing the various support flanges to the end plate 52. Hence, via this combination, both coils are secured relative to the end plate and the end plate acts to maintain the coils in this spaced apart position so that air may flow therebetween through bypass area 100 defined by the coils. Damper 54 is shown in a vertical position and includes a shaft 58 which is mounted within pivot opening 59 of end plate 52. Handle 56 is additionally shown connected to the damper such that a manual displacement of the handle results in rotational displacement of the damper.

As may be further seen in FIG. 2 the damper is shown in an upright position allowing full bypass of air through the bypass opening defined between the top portions of the left and right coils. When handle 56 is rotated, the damper is additionally rotated and may be rotated sufficiently far to completely block the bypass opening such that all air is forced to circulate through the coils making up the A-type heat exchanger.

Figure 3:
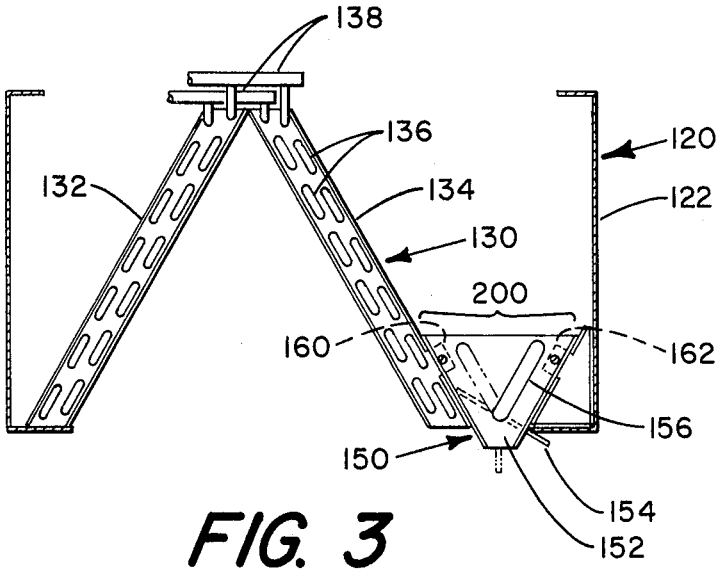
FIG. 3 is an alternative embodiment showing a bypass assembly located in a different position relative to the heat exchanger.

Referring now to FIG. 3, a separate embodiment of the same device is shown. In FIG. 3, the reference numerals are preceded by the numeral 1 for the same components. FIG. 3 shows casing 132 as part of coil unit 120 to define an air flow path therethrough. A-type heat exchanger 130 is shown having left and right coils 134 and 132. The two coils are joined at the top thereof. Additionally, return bends 136 and headers 138 are shown. The bottom right portion of coil 134 is shown as is flange 160 extending outwardly therefrom. Additionally, flange 162 extends inwardly from casing 132. These two flanges are joined to end plate 152 to secure the end plate in position between casing 132 and the exterior portion of coil 134 to define a bypass area 200 for allowing air to flow through the coil unit without flowing through the heat exchanger. Damper 154 is shown mounted as a portion of pypass assembly 150 and includes manual operator 156.

As shown herein, a manual operator such as handle 56 is utilized to position the damper. It is contemplated that a serviceman, upon installation of the air conditioning unit, would determine an appropriate position to effect the combination of latent and sensible cooling to be obtained by the heat exchange unit for that particular application and geographic location. In response to making this determination the serviceman would then set the damper of the bypass assembly in the appropriate position to allow for the amount of bypass air desired. This position might be fully closed if additional latent cooling is not desired and sensible cooling was all that was necessary for this particular application. In high humidity areas, it might be advantageous to have the damper 54 in a fully open position such that less sensible cooling and more latent cooling occurred to better satisfy the comfort needs of the space and to provide the occupants thereof with a conditioned stream which would more likely fall within the temperature humidity index comfort zone. In other words, in areas where humidity control is more effective for reducing the temperature humidity index than dry bulb temperature control or sensible cooling, a portion of the air flow is allowed to bypass the heat exchangers to effectively reduce the temperature of the heat exchangers to increase the amount of moisture removal from the air.

The invention has been described herein with reference to particular embodiments thereof. It is to be understood by those skilled in the art that variations and modifications can be effected within the spirit and scope of the invention.

What is claimed is:

1. A heat exchange unit for controlling the temperature and humidity of air to be conditioned having a casing defining an air flow path, a heat exchanger located in the air flow path within the casing for transferring heat energy between a fluid flowing through the heat exchanger and at least a portion of the air flowing through the casing, said heat exchanger extending across a portion of the air flow path defining a bypass area through which air may flow through the unit without being in heat exchange relation with the heat exchanger and damper means mounted to regulate the flow of air through the bypass area to apportion the air flow whereby a portion of the air flows through the heat exchanger and a portion of the air flows through the bypass area.

2. The apparatus as set forth in claim 1 wherein the damper means includes at least one flow blocking element and means to position the flow blocking element relative to air flow through the bypass area.

3. The apparatus as set forth in claim 2 wherein the flow blocking element is a rotatable damper capable of being positioned to apportion the flow of air through the heat exchanger and through the bypass area.

4. The apparatus as set forth in claim 1 wherein the heat exchanger comprises two heat exchange coils angled toward each other and wherein the bypass area is located between the two heat exchangers at the end of the heat exchangers closest to each other.

5. The apparatus as set forth in claim 4 wherein each heat exchanger coil includes a means for securing the damper means therebetween, said damper means including at least one end plate attached by the means for securing to the two heat exchange coils to maintain the heat exchange coils in the desired configuration and serving to rotatably secure a flow blocking means in position to regulate the flow of air between the two heat exchangers.

6. The apparatus as set forth in claim 5 and further comprising control means for positioning the flow blocking means to apportion the air flow between the bypass area and the heat exchange coils.

7. A heat exchange unit including an A-type indoor heat exchanger for use with an air conditioning system for supplying conditioned air which comprises:

a pair of heat exchange coils angled in opposite directions with the top portions of the two coils being closer together than the bottom portion of the heat exchange coils;

a casing in which the heat exchange coils are mounted, said casing defining an air flow path therethrough;

a bypass area within the casing through which air may flow through the casing without flowing through the heat exchanger; and damper means mounted to regulate air flow through the bypass area to apportion the air flow through the casing between flow through the bypass area and flow through the heat exchange coils.

8. The apparatus as set forth in claim 7 wherein the damper means includes at least one flow blocking element and means for rotatably supporting said blocking element within the bypass area.

9. The apparatus as set forth in claim 8 wherein the means for rotatably supporting the blocking element is secured to the top portion of each coil to maintain the coils in a desired position with the bypass area being defined between the two heat exchange coil top portions.

10. The apparatus as set forth in claim 9 wherein each heat exchange coil includes a support flange and wherein the means for rotatably supporting the blocking element is secured thereto.

11. The apparatus as set forth in claim 8 and further comprising positioning means for securing the flow blocking element in the desired position.

* * * * *